US009040793B2

(12) United States Patent
Magnusson

(10) Patent No.: US 9,040,793 B2
(45) Date of Patent: May 26, 2015

(54) PROTECTOR FOR MUSICAL INSTRUMENT AND PLAYER

(71) Applicant: Ari Magnusson, Charlestown, MA (US)

(72) Inventor: Ari Magnusson, Charlestown, MA (US)

(73) Assignee: Stringcessories LLC, Charlestown, MA (US)

( * ) Notice: Subject to any disclaimer, the term of this patent is extended or adjusted under 35 U.S.C. 154(b) by 0 days.

(21) Appl. No.: 14/172,622

(22) Filed: Feb. 4, 2014

(65) Prior Publication Data

US 2014/0216229 A1 Aug. 7, 2014

Related U.S. Application Data

(60) Provisional application No. 61/760,252, filed on Feb. 4, 2013.

(51) Int. Cl.
*G10D 3/18* (2006.01)
*G10G 7/00* (2006.01)

(52) U.S. Cl.
CPC ... *G10D 3/18* (2013.01); *G10G 7/00* (2013.01)

(58) Field of Classification Search
CPC ..... G10D 3/18; G10G 7/00
See application file for complete search history.

(56) References Cited

U.S. PATENT DOCUMENTS

| | | | | | |
|---|---|---|---|---|---|
| 270,443 | A * | 1/1883 | Kraemer | 150/162 |
| 1,156,925 | A | 10/1915 | Poehland | |
| 1,607,794 | A * | 11/1926 | Lorant | 84/279 |
| 1,723,687 | A * | 8/1929 | Elkington | 84/328 |
| 1,742,305 | A * | 1/1930 | Connell | 84/278 |
| 1,821,811 | A * | 9/1931 | Mai | 84/279 |
| 3,309,954 | A * | 3/1967 | Phillips et al. | 84/453 |
| 4,000,678 | A * | 1/1977 | Messina | 84/453 |
| 4,084,477 | A * | 4/1978 | Dominguez | 84/327 |
| 5,725,094 | A * | 3/1998 | Moral | 206/314 |
| 6,054,642 | A * | 4/2000 | Brooks | 84/267 |
| 6,239,337 | B1 | 5/2001 | Stein | |
| 6,410,834 | B1 * | 6/2002 | Hearfield | 84/453 |
| 6,441,288 | B1 * | 8/2002 | Lin | 84/453 |
| 6,624,346 | B2 * | 9/2003 | Standish | 84/280 |
| 6,627,801 | B2 * | 9/2003 | Casamento | 84/290 |
| 6,946,593 | B2 * | 9/2005 | Goodman et al. | 84/398 |
| 7,453,034 | B2 * | 11/2008 | Johnson | 84/329 |
| 7,488,881 | B2 * | 2/2009 | Kessler | 84/329 |
| 7,671,264 | B1 * | 3/2010 | Heda | 84/453 |

(Continued)

FOREIGN PATENT DOCUMENTS

| | | |
|---|---|---|
| AU | 714974 B2 | 1/2000 |
| CA | 2202828 A1 | 10/1998 |

*Primary Examiner* — Robert W Horn

(74) *Attorney, Agent, or Firm* — Burns & Levinson LLP; Joseph M. Maraia

(57) ABSTRACT

Embodiments of the present disclosure include systems and apparatus for protecting a musical instrument and the player of said instrument. One embodiment is an apparatus that includes a first layer including a moisture permeable and wicking material configured to wick fluid and moisture across and through the layer. The first layer includes a first player-facing surface and a first musical instrument facing surface. The apparatus also includes a second layer including a second player-facing surface and a second musical instrument facing surface, wherein the second player-facing surface abuts the first musical instrument facing surface of the first layer. The second layer includes a moisture impermeable material configured to prevent the wicked fluid and moisture to come into contact with the musical instrument.

14 Claims, 7 Drawing Sheets

(56) References Cited

U.S. PATENT DOCUMENTS

| | | | | |
|---|---|---|---|---|
| 7,956,270 | B1 * | 6/2011 | Burmeister et al. | 84/453 |
| 8,637,756 | B1 * | 1/2014 | Brawley | 84/453 |
| 2008/0047637 | A1 * | 2/2008 | Mosier | 150/154 |
| 2008/0216633 | A1 * | 9/2008 | Winch | 84/329 |
| 2010/0122755 | A1 * | 5/2010 | Post | 150/162 |
| 2014/0076122 | A1 * | 3/2014 | Toyonaga | 84/453 |
| 2014/0216229 | A1 * | 8/2014 | Magnusson | 84/278 |
| 2014/0345439 | A1 * | 11/2014 | Boykin | 84/453 |

* cited by examiner

PROTECTOR FOR MUSICAL INSTRUMENT AND PLAYER

RELATED APPLICATION(S)

This application claims the benefit of U.S. Provisional Application No. 61/760,252, filed on Feb. 4, 2013. The entire teachings of the above application(s) are incorporated herein by reference.

BACKGROUND

Musical instruments such as violas and violins typically comprise a neck and a body having an upper surface and a lower surface separated by a rib. Strings, which run from a pegbox or head provided on the neck of the instrument and over a bridge provided on the upper surface of the instrument body, are attached to a tailpiece which is secured via a pin to the bottom of the instrument body. The body typically comprises a hollow resonance box in acoustic instruments of the violin or viola type, the components of which are joined by a moisture- and heat-sensitive glue, as is known in the art, or the body may also be solid such as in the case of electric violins and violas, which use one or more electric pickups and amplification devices to increase the sound of string vibrations. The instrument body and head are generally made of wood and coated with a varnish for protection and aesthetic enhancement, as is known in the art. A chinrest is generally provided on the upper surface of the instrument body; the chinrest is clamped to the instrument body using conventional hardware or variations on the convention. Players rest their jaws/chins on the chinrest when playing, and some players necks come into contact with the chinrest hardware and instrument body. Some players prefer to play in a traditional style, i.e. without a chinrest, and rest their jaws/chins directly on the top surface of the instrument, with some players' necks coming into contact with the instrument body.

SUMMARY

Embodiments of the present disclosure include systems and apparatus for protecting a musical instrument and the player of said instrument. One embodiment is an apparatus that includes a first layer including a moisture permeable and wicking material configured to wick fluid and moisture from the player across and through the layer. The first layer includes a first player-facing surface and a first musical instrument facing surface. The apparatus also includes a second layer including a second player-facing surface and a second musical instrument facing surface, wherein the second player-facing surface abuts the first musical instrument facing surface of the first layer. The second layer includes a moisture impermeable material configured to prevent the wicked fluid and moisture from coming into contact with the musical instrument.

The first layer can be adapted to be in contact with a skin surface of a player. Also, at least one of the first layer and the second layer can be adapted to be antimicrobial. In addition, at least one of the first layer and the second layer can also be adapted to be compressible.

The moisture impermeable material can include a fabric adapted to protect the surfaces and seams of the musical instrument and the chinrest and hardware from moisture. For example, the fabric can be chemically treated to substantially prevent moisture transfer through the fabric. Also, the fabric can include a weaving pattern configured to substantially prevent moisture transfer through the fabric. The fabric can include a non-woven sheet configured to substantially prevent moisture transfer through the fabric. In addition, the second layer can include a membrane configured to substantially prevent moisture transfer through the second layer.

The moisture impermeable material can be adapted to protect the varnish, surface of the musical instrument, and/or chinrest from contact with the apparatus. For example, the fabric can have soft fibers on the musical instrument facing side that cannot scratch or mar the varnish, instrument surface, or chinrest.

A non-skid material can be affixed to the second musical instrument facing side of the second layer. For instance, the non-skid material can be configured to substantially prevent movement of the apparatus relative to the musical instrument. Also, the second musical instrument facing side of the second layer can include an adhesive material configured to non-permanently adhere the apparatus to the musical instrument. For example, a sticky rubber can be affixed to the second musical instrument facing side of the second layer to allow the apparatus to temporarily attach to the chinrest cup of the instrument.

Another embodiment is an apparatus for protecting a musical instrument that includes a first layer, a second layer, and a third layer. The first layer includes a moisture permeable and wicking material configured to wick fluid and moisture from the player across and through the layer. In addition, the first layer has a first player-facing surface and a first musical instrument facing surface. The second layer includes a moisture absorbing material. The second layer has a second player-facing surface and a second musical instrument facing surface, wherein the second player-facing surface abuts the first musical instrument facing surface of the first layer. The third layer includes a third player-facing surface and a third musical instrument facing surface. The third player-facing surface abuts the second musical instrument facing surface of the second layer. Also, the third layer includes a moisture impermeable material configured to prevent the wicked and absorbed fluid and moisture from coming into contact with the musical instrument.

Another embodiment is an apparatus for protecting a musical instrument that includes a first layer and a second layer. The first layer includes a moisture absorbing material configured to absorb moisture from the player. The first layer has a first player-facing surface and a first musical instrument facing surface. The second layer includes a second player-facing surface and a second musical instrument facing surface. The second player-facing surface abuts the first musical instrument facing surface of the first layer. Also, the second layer includes a moisture impermeable material configured to prevent the absorbed moisture from coming into contact with the musical instrument.

Yet another embodiment is an apparatus for protecting a musical instrument that includes a first layer, a second layer, and a third layer. The first layer includes a moisture absorbing material configured to absorb moisture from the player. The first layer has a first player-facing surface and a first musical instrument facing surface. The second layer includes a moisture wicking material configured to wick fluid into a second moisture absorbing material of the second layer. The second layer has a second player-facing surface and a second musical instrument facing surface. The second player-facing surface abuts the first musical instrument facing surface of the first layer. The third layer includes a third player-facing surface and a third musical instrument facing surface. The third player-facing surface abuts the second musical instrument facing surface of the second layer. The third layer includes a moisture impermeable material configured to prevent the wicked and absorbed fluid and moisture from coming into contact with the musical instrument.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Figure 1:
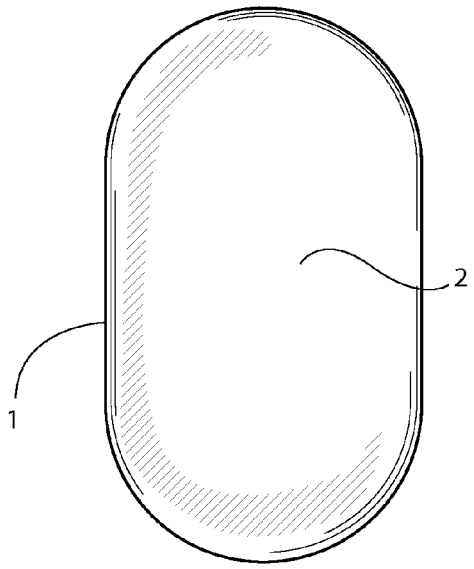
FIG. 1 is a top view of an example embodiment the presently disclosed apparatus showing the moisture permeable and wicking player-facing surface.

Some players of violins, violas, and similar musical instruments suffer adverse physiological (e.g. dermatological) effects and/or discomfort, such as redness, rashes, sores, itching, swelling, and the like, as well as physical discomfort on the neck, jaw, and/or chin from contact with the instrument and instrument accessories. For instance, an edge of a chinrest cup and the wood of the chinrest itself. The edge of the chinrest cup generally forms an approximately ninety degree angle and can have a somewhat sharp edge on some models. In addition, the chinrest cup, chinrest edges, and chinrest hardware do not absorb moisture. Perspiration from the player remains in contact with his or her skin while playing, leading to and/or exacerbating rashes, sores and chaffing, and other adverse dermatological conditions caused by chinrest friction and/or excessive moisture. This constant contact between hard wood of the instrument and the player and resulting adverse physiological effects can cause discomfort.

Another problem is that varnish, wood, and accessories such as the chinrest and chinrest hardware of violins, violas, and similar musical instruments experience wear, discoloration, deterioration, and degradation from contact with the player. In particular, the varnish on the lower bass rib in the chinrest area, which is closest to the player's chin and neck, is frequently worn away and the wood darkened from contact with the player's skin, player's perspiration, and substances on a player's skin. Further degradation can include warping and cracking of the rib from the combination of chinrest pressure and warm moisture from the player. In addition, the seams in this area—the joints formed by the top of the rib and the top of the instrument and the bottom edge of the rib and the back of the instrument—can separate or come apart from the warm moisture as the glue used to bind the wooden parts of such instruments softens and loses strength when exposed to moist heat. The chinrest, particularly the metal hardware, can also discolor and degrade. In addition, makeup and other substances applied to the skin can adhere to the instrument surface and even get into open seams, which can make regluing the seams difficult. And some players do not use chinrests at all, preferring to rest their chins directly on the top plate of the instrument, which can significantly degrade and damage the varnish and wood of the instrument from both perspiration, makeup, and other substances, and friction from the skin and facial hair.

Another common problem is that many players have an allergic reaction to parts of the chinrest such as the metal hardware. For example, some people are allergic to nickel; contact with the metal parts of the hardware that contain nickel will cause a reaction. In addition, the salts, oils, and other compounds in a player's perspiration and/or substances on the player's skin such as makeup, skin lotions, aftershave, creams, oils, and/or the like, can react with the metals and other compounds in the chinrest hardware and cause a variety of adverse physiological (e.g. dermatological) effects and/or discomfort.

It is an object of the presently described apparatus to provide a protector for both a musical instrument of the violin or viola type and for the player of such instrument.

The present disclosure relates to a protection device for a musical instrument such as a violin, viola or other similar instrument and for the player of such instrument, and more particularly, to a device which covers a portion of a musical instrument to protect the varnish, wood, structural seams, and chinrest of the instrument from degradation from the perspiration and/or cosmetic products applied to the skin of the player, and also to protect the player from any adverse physiological (e.g., dermatological) effects and/or discomfort from perspiration and/or contact with various instrument components including the wood, varnish, chinrest cup, chinrest edges, and/or chinrest hardware.

An embodiment of the present disclosure includes an apparatus that protects the instrument from the perspiration of the player and the player from adverse physiological (e.g. dermatological) effects and/or discomfort from contact with the instrument. The apparatus of the present disclosure is designed to manage moisture (absorb, disperse, dissipate, and prevent migration to the musical instrument). In another embodiment, the apparatus also provides cushioning and inhibits bacterial growth.

It is a further object of an embodiment of the present disclosure to protect the player of a musical instrument from any adverse physiological (e.g. dermatological) effects and/or discomfort from contact with the instrument and accessories such as the chinrest. Substances that the player could come into contact with include but are not limited to metal, plastic, or composite chinrest hardware, polish residue from cleaning of the instrument, plastic accessories such as the tailgut or synthetic chinrest, wood, and varnish.

It is a further object of an embodiment of the present disclosure to protect the player of a musical instrument from adverse physiological (e.g. dermatological) effects and/or discomfort by providing a cushioning layer between the player and the musical instrument and accessories such as a chinrest. In one embodiment, the cushioning layer is provided by the aggregate compressibility of the materials that comprise the apparatus. In another embodiment, this cushioning layer is provided through the use of an added layer comprised of resilient fibers which do not lose their compressibility over time as can happen with the foam pads and inserts used by other devices.

FIG. 1 is a top view of an embodiment of the presently described apparatus 1. The apparatus 1 includes a moisture permeable and wicking player-facing layer 2 (e.g., a moisture permeable layer with wicking properties, a layer of moisture permeable and wicking material, etc.). The player-facing layer 2 can include any woven, non-woven, flocked, knit, extruded, molded, or otherwise formed natural and/or non-natural/synthetic material or combination thereof, such as, for example, cotton, polyester, nylon, acrylic, rayon, and the like, that allows wicking (e.g., migration/traversal) of moisture from a top planar surface of the player-facing layer 2 to a bottom planar surface of the layer 2. In one embodiment, the moisture permeable and wicking player-facing layer 2 is composed of a woven polyester fabric. In another embodiment, the moisture permeable and wicking player-facing layer 2 is composed of a woven fabric such as cotton treated with a chemical to impart wicking properties. In another embodiment, the moisture permeable player-facing layer 2 is composed of a woven polyester fabric with an anti-microbial treatment.

Figure 2:
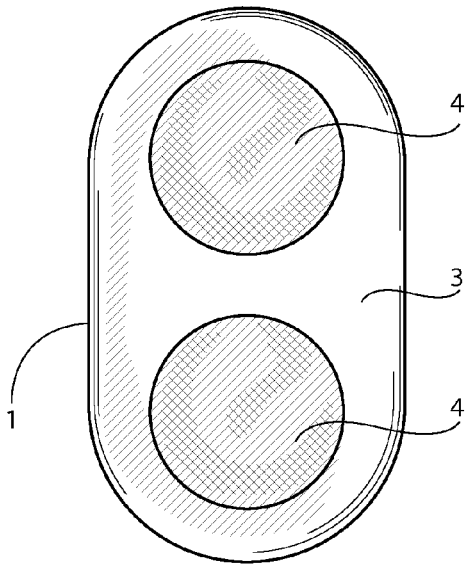
FIG. 2 is a bottom view of an example embodiment the presently disclosed apparatus showing the protective instrument-facing surface and non-slip elements.

FIG. 2 depicts a bottom view of the apparatus 1, with moisture-impermeable instrument surface-protecting layer 3 (e.g., a moisture impermeable layer, a layer of moisture impermeable material, etc.) and non-slip elements 4. The instrument-protecting surface 3 can be comprised of any woven, non-woven, flocked, knit, extruded, molded, or otherwise formed natural and/or non-natural/synthetic material or combination thereof, such as cotton, polyester, nylon, acrylic, rayon, plastic, latex, rubber, and the like, that will not scratch or otherwise damage the surface of the instrument, including the wood, varnish, and accessories and that is moisture impermeable, moisture repellant, or substantially moisture impervious (e.g., via chemical treatment, via weaving pattern, via fabric substrate, via material properties in the case of a plastic lamination, etc.) and prevents moisture from migrating from one planar surface to the other planar surface. In one embodiment, the instrument-protecting surface layer 3 is composed of a synthetic fabric consisting of a woven nylon substrate coated with polyester fibers. The non-slip elements 4 can be comprised of any natural or synthetic material or combination thereof, such as natural rubber, neoprene rubber, sticky rubber, plastic, foam, and the like, that substantially prevents or prevents movement of apparatus 1 relative to the instrument and/or non-permanently adheres apparatus 1 to the instrument when in use. Although FIG. 2 shows two non-slip elements 4, any number of non-slip elements can be used. In one embodiment, the non-slip elements are composed of thin pieces of neoprene rubber. In another embodiment, the non-slip elements are composed of a sticky rubber.

In another embodiment, the moisture impermeable and instrument surface-protecting layer 3 is composed of a moisture-impermeable non-woven synthetic sheet such as nylon coated with polyester fibers. In yet another embodiment, the moisture impermeable and instrument surface-protecting layer 3 is composed of a layer of compressible rubber, latex, plastic, or the like adhered to a fabric. In still yet another embodiment, the moisture impermeable and instrument surface-protecting layer 3 is composed of a layer of compressible rubber, latex, plastic, or the like. In yet another embodiment, the moisture impermeable and instrument surface-protecting layer 3 is composed of a layer of natural or synthetic fabric (e.g., cotton, hemp, polyester) treated with a moisture repellant substance. In another embodiment, the moisture impermeable and instrument surface-protecting layer 3 is composed of a moisture impermeable membrane (e.g., polyethylene film, wax membrane) adhered (e.g., physical connection, adhesive, heat sealed) to a fabric (e.g., cotton, polyester).

Figure 3:
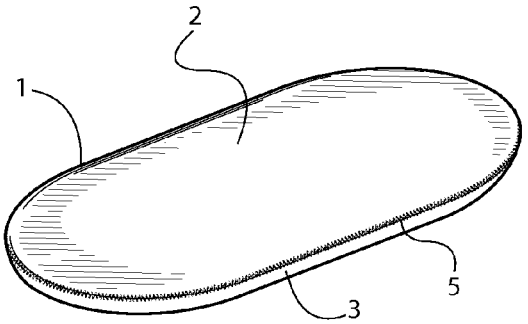
FIG. 3 is a perspective view of the top of an example embodiment the presently disclosed apparatus.

FIG. 3 depicts an elevated perspective view of the top of apparatus 1, showing the junction 5 of moisture permeable and wicking player-facing layer 2 and instrument-protecting layer 3. The two surfaces can be joined by stitching, heat sealing, radio-frequency welding, non-substrate containing adhesive (e.g. glue), substrate containing adhesive (e.g. tape), zipper, Velcro, buttons, snaps, and/or other means. In one embodiment, the junction 5 is created by stitching.

Figure 4:
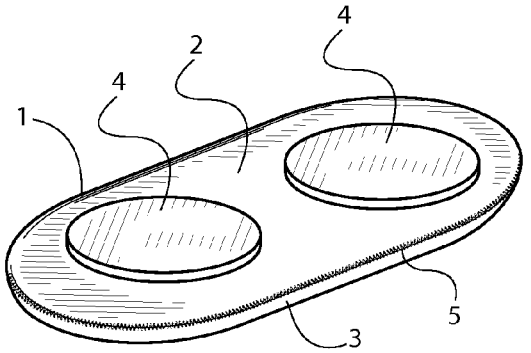
FIG. 4 is a perspective view of the bottom of an example embodiment the presently disclosed apparatus.

FIG. 4 depicts an elevated perspective view of the bottom of apparatus 1, showing the junction 5 of moisture permeable and wicking player-facing layer 2 and moisture impermeable and instrument surface-protecting layer 3, and non-slip elements 4.

Figure 5:
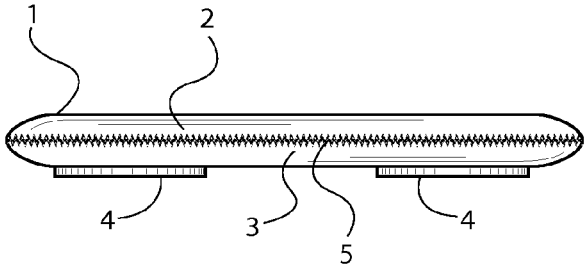
FIG. 5 is a side edge view of an example embodiment the presently disclosed apparatus of which the other side is a mirror image.

FIG. 5 depicts a side edge view of apparatus 1, with moisture permeable and wicking player-facing layer 2, moisture impermeable and instrument surface-protecting layer 3, junction 5 of moisture permeable and wicking player-facing layer 2 and moisture impermeable and instrument surface-protecting layer 3, and non-slip elements 4.

Figure 6:
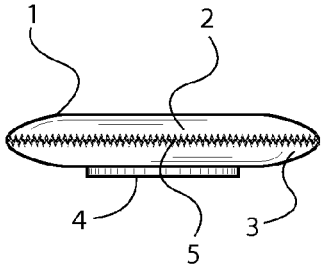
FIG. 6 is a bottom end view of an example embodiment the presently disclosed apparatus of which the other end is a mirror image.

FIG. 6 depicts a bottom end edge view of apparatus 1, with moisture permeable and wicking player-facing layer 2, moisture impermeable and instrument surface-protecting layer 3, junction 5 of moisture permeable player-facing layer 2 and instrument-protecting layer 3, and non-slip element 4.

Figure 7:
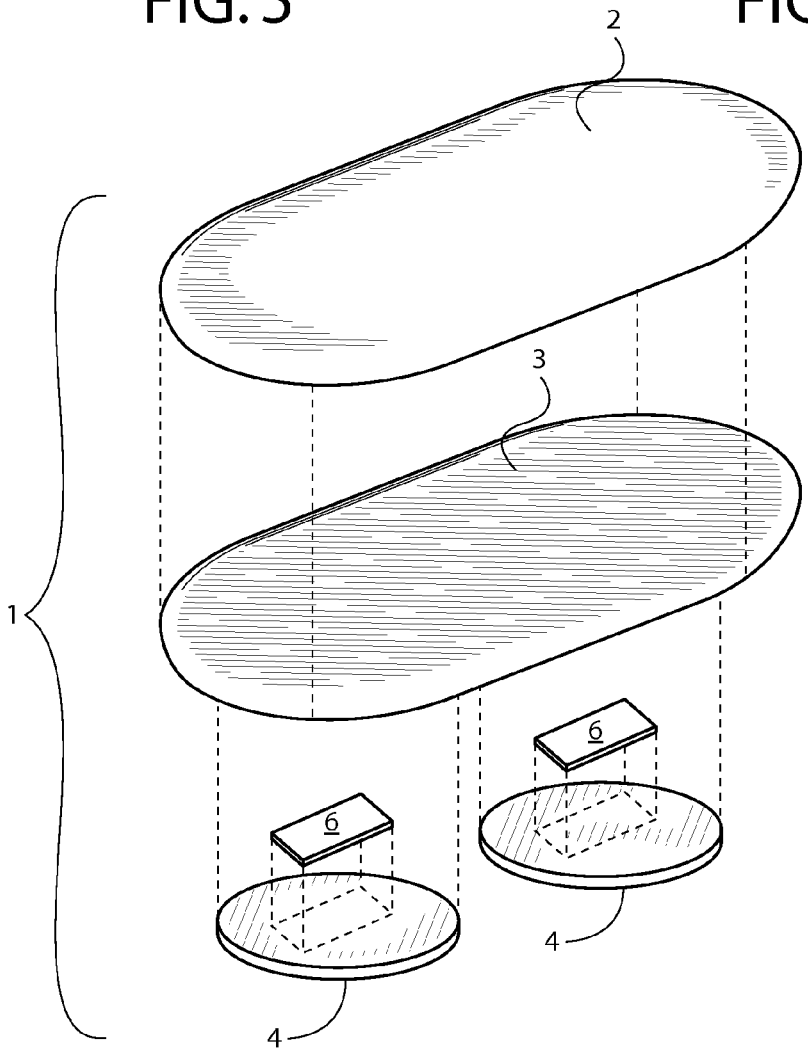
FIG. 7 is an exploded view of an example embodiment of the presently disclosed apparatus.

FIG. 7 depicts an exploded view of an embodiment of present apparatus 1, showing moisture permeable and wicking player-facing layer 2, moisture impermeable instrument surface-protecting layer 3, non-slip elements 4, and non-slip element attachment means 6. The non-slip element attachment means 6 can be comprised of any natural or synthetic material such as a chemical adhesive, glue, double-sided tape, or thread, that adheres the non-slip element 4 to instrument-protecting surface 3. In one embodiment, the moisture permeable and wicking player-facing layer 2 is composed of a woven polyester fabric; the moisture impermeable and instrument surface-protecting layer 3 is composed of a synthetic fabric consisting of a woven nylon substrate coated with polyester fibers; the non-slip elements 4 are composed of a thin piece of neoprene rubber; the non-slip element attachment means 6 are composed of a double-sided adhesive tape. In another embodiment, the non-slip element attachment means 6 is composed of a stitched thread. In yet another embodiment, the attachment means 6 is not a separate and distinct material but rather is provided via a property of the non-slip element 4 itself (e.g., a stickiness). In another embodiment the moisture permeable and wicking player-facing layer 2 and/or the moisture impermeable and instrument surface-protecting layer 3 contains silver or a chemical treatment to make the layer antimicrobial.

Figure 8:
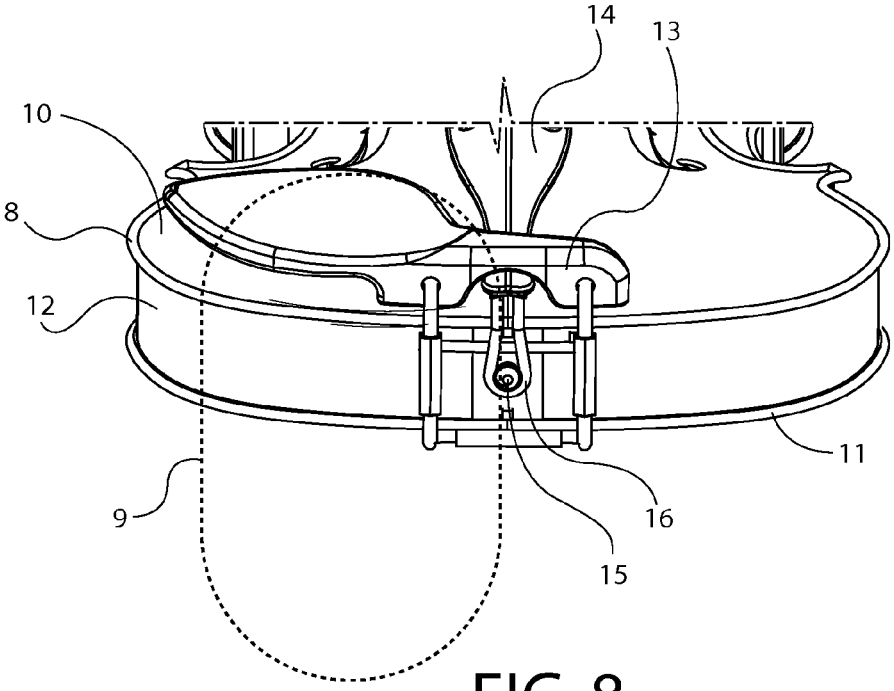
FIG. 8 is an elevated perspective view of a chinrest end of a violin showing an approximate area that an example embodiment the presently disclosed apparatus can cover.

FIG. 8 depicts a chinrest end of an instrument 8 showing the approximate portion 9 that the present apparatus would cover for a standard over-the-end block tailpiece (with a chinrest cup position to one side of the tailpiece). The instrument body features a generally gently arched top surface 10, a back surface 11, and a flat rib 12 interposed between the top and back surfaces (also referred to as the bottom rib area). A standard over-the-tailpiece chinrest 13 is positioned on the top surface 10. Tailpiece 14 attaches to endpin 15 via tailgut 16. Note that chinrest height and instrument thickness can be variable so the exact area of coverage by the apparatus can vary.

Figure 9:
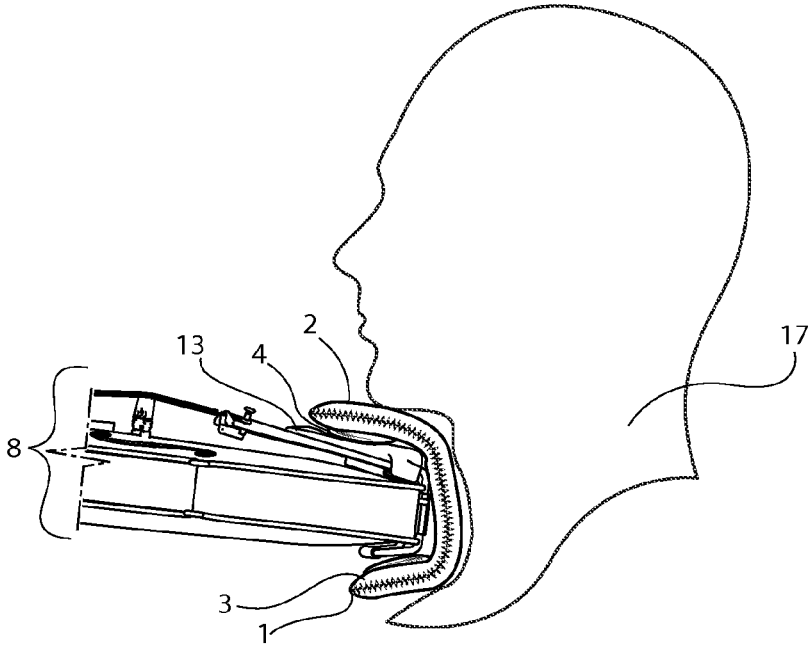
FIG. 9 is a fragmentary side view of a chinrest end of a violin, an embodiment of the presently described apparatus, and a violin player.

FIG. 9 depicts a fragmentary view of the chinrest end of the instrument 8, present apparatus 1, and player 17. Apparatus 1 is held in place between instrument 8 and player 17 by the pressure of instrument 8 pressed against player 17. To use the apparatus, the player 17 holds apparatus 1 against his or her neck and under his or her chin and brings instrument 8 up into the playing position. The non-slip element 4 that is resting in the chinrest cup prevents apparatus 1 from moving substantially relative to the chinrest 13 or instrument 8 (two non-slip elements are provided to allow either end to be placed in the chinrest cup). Thus, during use, moisture permeable and wicking player-facing layer 2 draws moisture from the skin of player 17 and allows it to dissipate or evaporate to keep the skin dry and prevent, for example, rashes, chaffing, and/or other discomforts. In addition, moisture impermeable and instrument surface-protecting layer 3 prevents the moisture and/or other substances (e.g., cosmetics) on the skin of player 17 from contacting instrument 8 and chinrest 13, preventing damage to instrument 8 and/or chinrest 13. Moreover, moisture impermeable and instrument surface-protecting layer 3 protects instrument 8 by providing a soft interface between apparatus 1 and instrument 8. Apparatus 1 also prevents the player 17 from coming into direct contact with instrument 8, to prevent discomfort from any dermatological reaction (e.g., allergic reaction) to instrument 8 or the components. The compressibility of apparatus 1 provides a cushioning layer between player 17 and instrument 8 to prevent discomfort to player 17 from any hard edges or surfaces of instrument 8. Apparatus 1 optionally inhibits bacterial growth on or within the apparatus 1.

Figure 10:
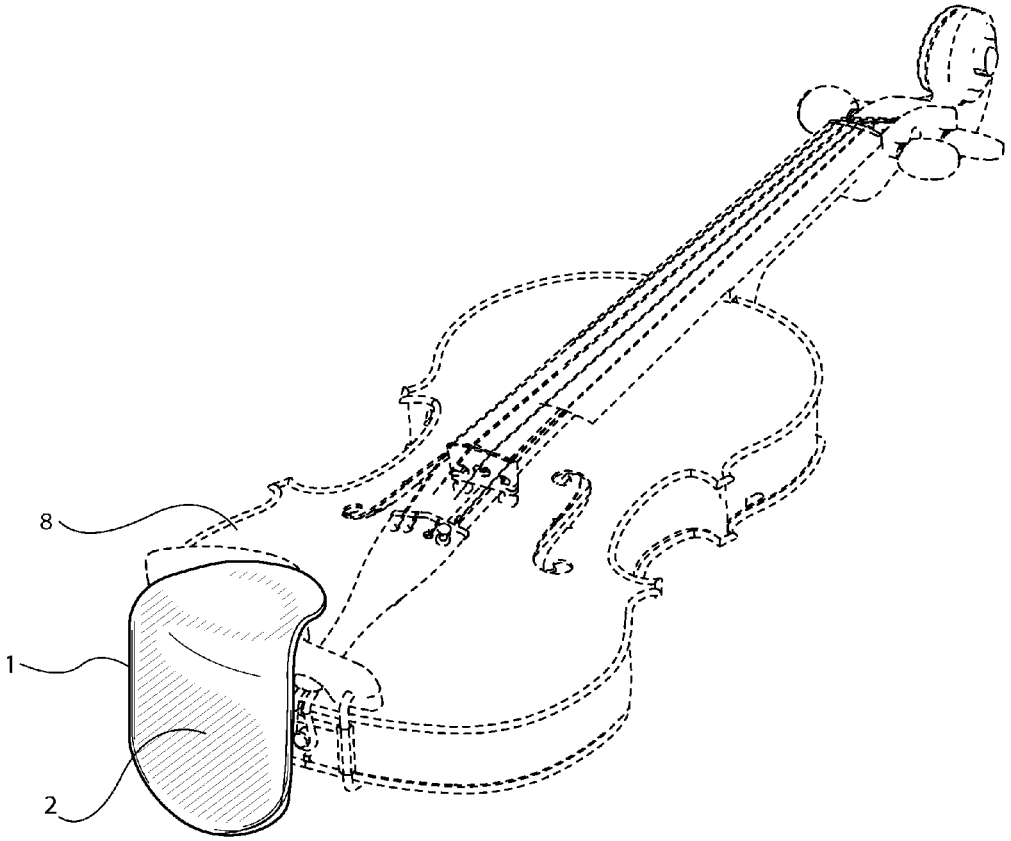
FIG. 10 is a perspective view of a violin with an example embodiment of the presently disclosed apparatus shown in position.

FIG. 10 depicts a perspective view of the embodiment of apparatus 1 shown in FIG. 1, with moisture permeable player-facing layer 2, in approximate position on instrument 8.

Figure 11:
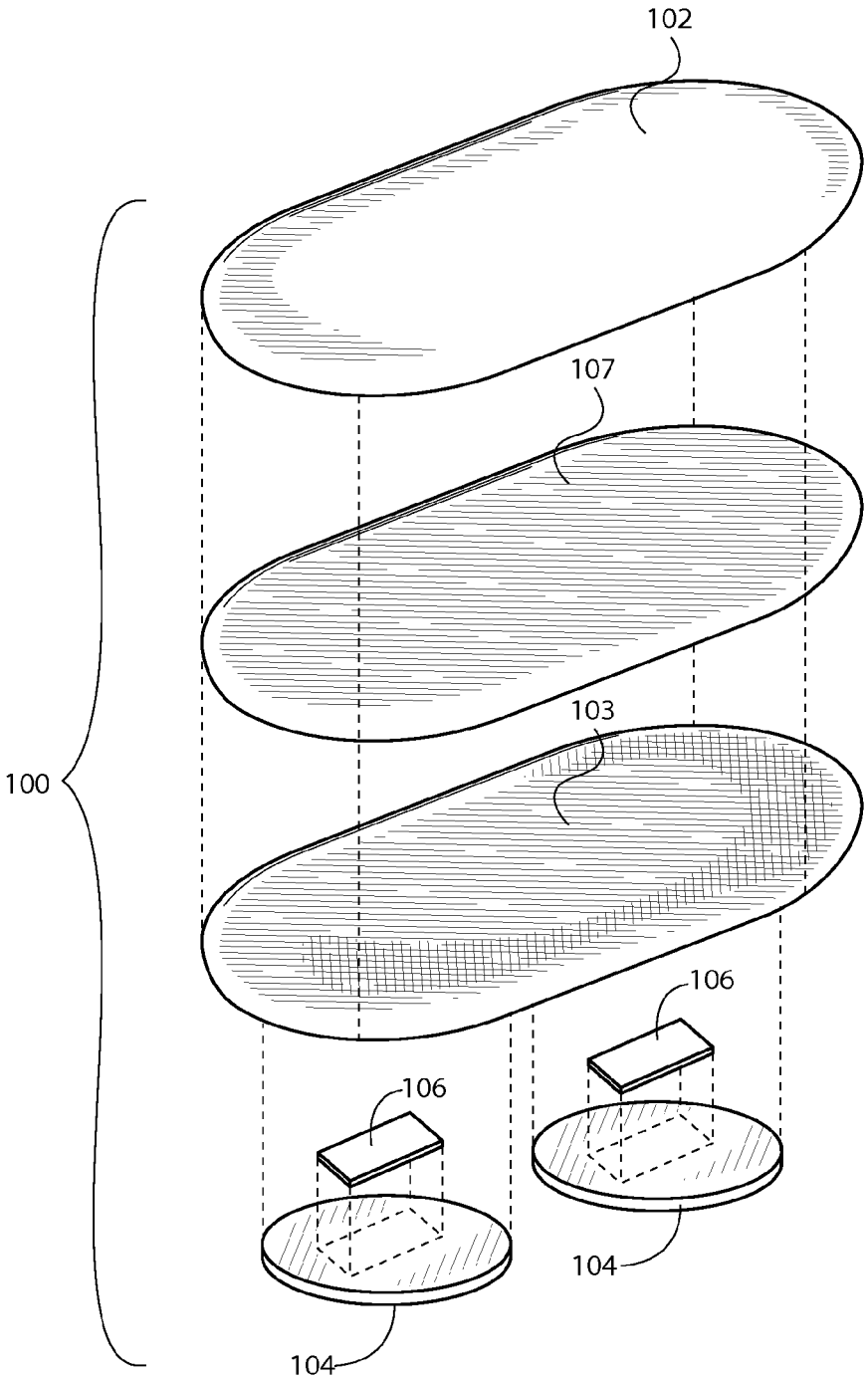
FIG. 11 is an exploded view of another example embodiment of the presently disclosed apparatus.

FIG. 11 depicts an exploded view of an apparatus 100 in accordance with an example embodiment of the present disclosure. The apparatus 100 includes a moisture permeable and wicking player-facing layer 102, moisture absorbent layer 107, moisture impermeable instrument surface-protecting layer 103, non-slip elements 104, and non-slip element attachment means 106. In one embodiment, the player-facing layer 102 is composed of a moisture permeable and wicking synthetic fabric such as a knit polyester fleece; the moisture absorbent layer 107 is composed of a natural fabric with porous fibers such as cotton; the moisture impermeable and instrument surface-protecting layer 103 is composed of a synthetic fabric consisting of a woven nylon substrate coated with polyester fibers; the non-slip elements 104 are composed of a thin piece of neoprene rubber; the non-slip element attachment means 106 are composed of a double-sided tape. In another embodiment the moisture permeable and wicking player-facing layer 102, the moisture absorbent layer 107, and/or the moisture impermeable and instrument surface-protecting layer 103 contains silver or a chemical treatment to make the layer antimicrobial.

Figure 12:
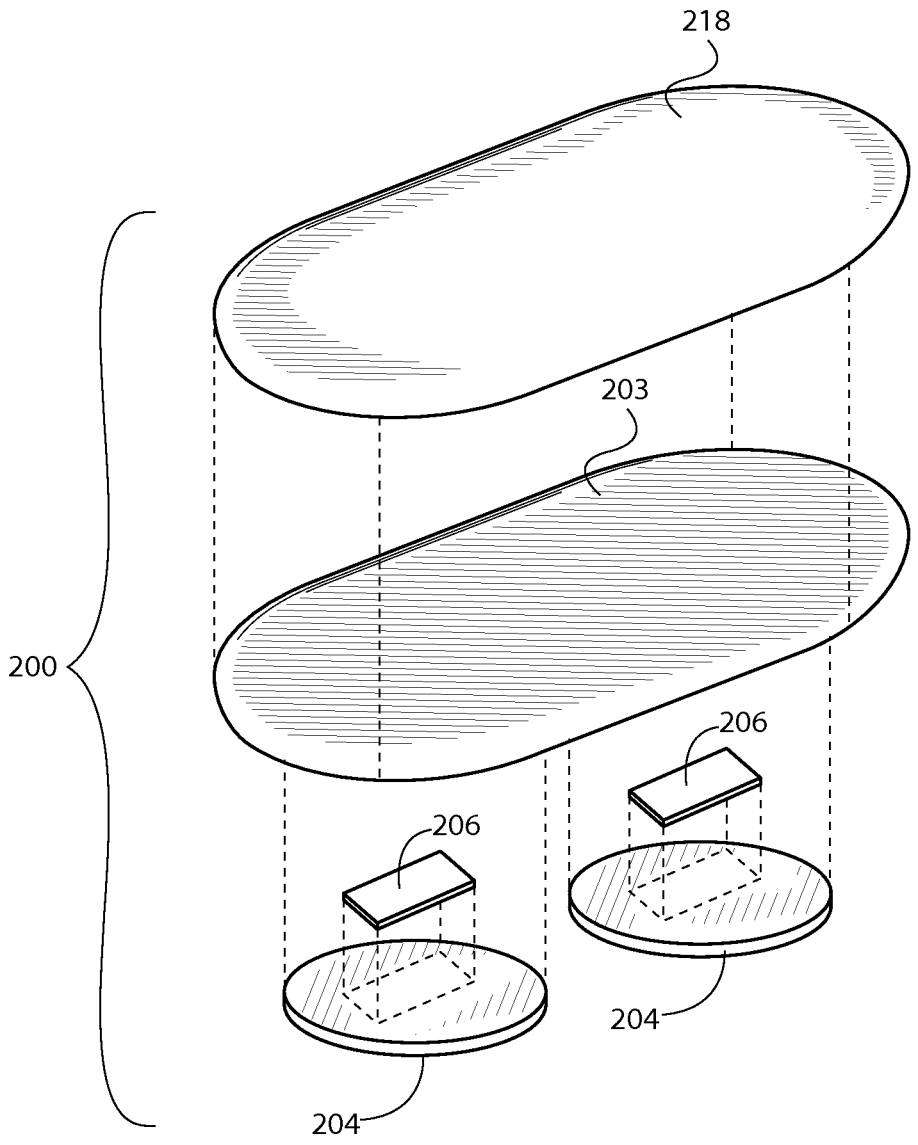
FIG. 12 is an exploded view of another example embodiment of the presently disclosed apparatus.

FIG. 12 depicts an exploded view of an apparatus 200 in accordance with an example embodiment of the present disclosure. The apparatus 200 includes a moisture absorbent player-facing layer 218, moisture impermeable instrument surface-protecting layer 203, non-slip elements 204, and non-slip element attachment means 206. In one embodiment, the moisture absorbent player-facing layer 218 is composed of a cotton fabric; the moisture impermeable and instrument surface-protecting layer 203 is composed of a synthetic fabric consisting of a woven nylon substrate coated with polyester fibers; the non-slip elements 204 are composed of a thin piece of neoprene rubber; the non-slip element attachment means 206 are composed of a double-sided tape. In another embodiment the moisture absorbent player-facing layer 218 and/or the moisture impermeable and instrument surface-protecting layer 203 contains silver or a chemical treatment to make the layer antimicrobial.

Figure 13:
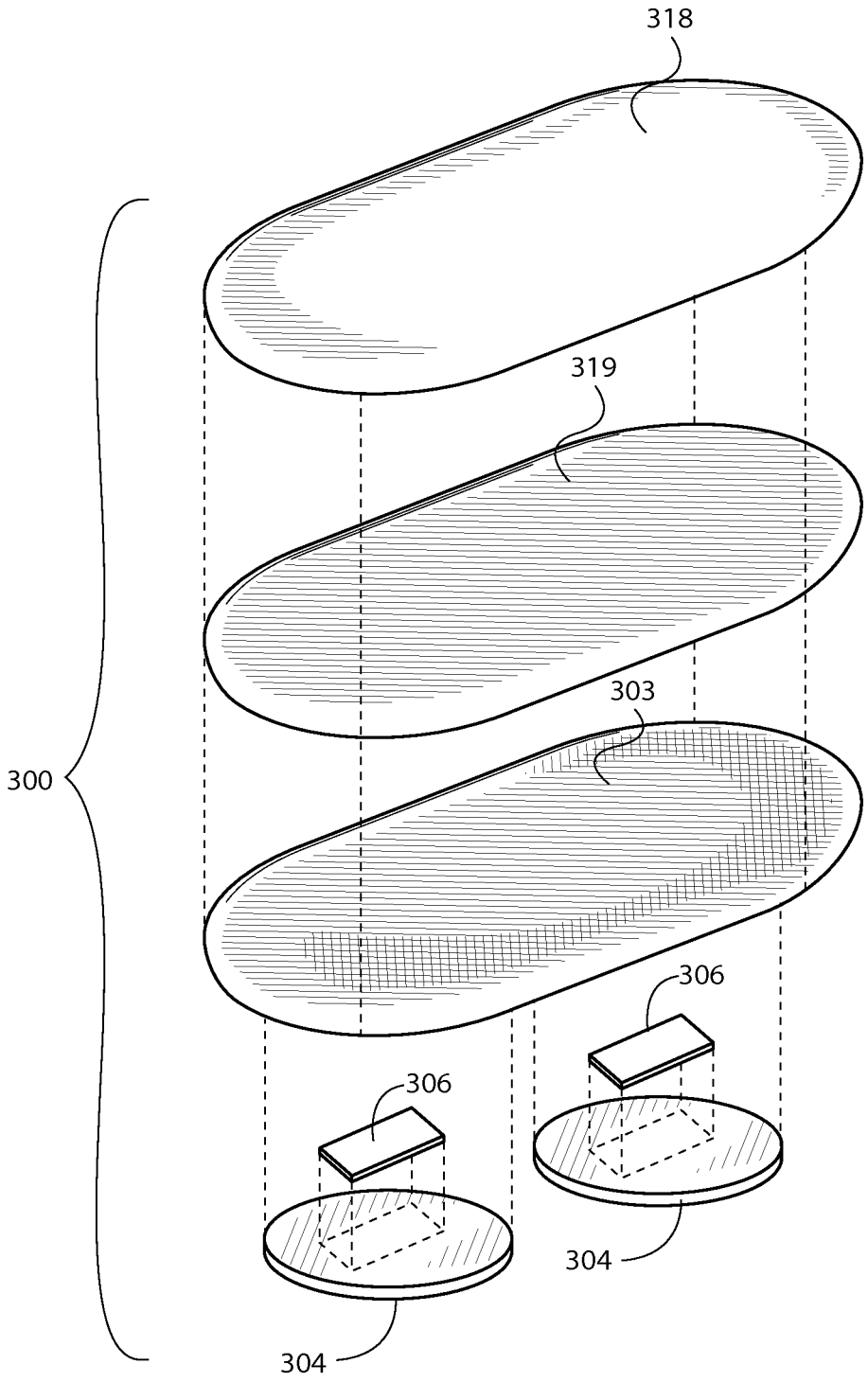
FIG. 13 is an exploded view of another example embodiment of the presently disclosed apparatus.

FIG. 13 depicts an exploded view of an apparatus 300 in accordance with an example embodiment of the present disclosure. The apparatus 300 includes a moisture absorbent player-facing layer 318, moisture wicking and absorbent layer 319, moisture impermeable instrument surface-protecting layer 303, non-slip elements 304, and non-slip element attachment means 306. In one embodiment, the player-facing layer 318 is composed of a cotton fabric; the moisture wicking and absorbent layer 319 is composed of a synthetic fabric consisting of polyester fibers attached to a moisture-absorbent polyester substrate; the moisture impermeable and instrument surface-protecting layer 303 is composed of a synthetic fabric consisting of a woven nylon substrate coated with polyester fibers; the non-slip elements 304 are composed of a thin piece of neoprene rubber; the non-slip element attachment means 306 are composed of a double-sided tape. In another embodiment the moisture absorbent player-facing layer 318, the moisture wicking and absorbent layer 319, and/or the moisture impermeable and instrument surface-protecting layer 303 contains silver or a chemical treatment to make the layer antimicrobial.

Other embodiments of the present disclosure will be apparent to those skilled in the art from a consideration of the specification or practice of the apparatus disclosed herein. It is intended that the specification and examples be considered as exemplary only, with the true scope and spirit of the disclosure being indicated by the following claims.

What is claimed is:

1. An apparatus for protecting a musical instrument and the player of said musical instrument, the apparatus comprising:

a first layer including a moisture permeable and wicking material configured to wick fluid and moisture across and through the layer, the first layer having a first player-facing surface and a first musical instrument facing surface; and a second layer including a second player-facing surface and a second musical instrument facing surface, wherein the second player-facing surface abuts the first musical instrument facing surface of the first layer, the second layer including a moisture impermeable material configured to prevent the wicked fluid and moisture from coming into contact with the musical instrument, and adapted to prevent damage to the surface of the musical instrument.

2. The apparatus of claim 1 wherein the first layer is adapted to be in contact with a skin surface of a player.

3. The apparatus of claim 1 wherein at least one of the first layer and the second layer is adapted to be antimicrobial.

4. The apparatus of claim 1 wherein at least one of the first layer and the second layer is adapted to be compressible.

5. The apparatus of claim 1 wherein the moisture impermeable material includes a fabric adapted to protect a surface of the musical instrument.

6. The apparatus of claim 5 wherein the fabric is chemically treated to substantially prevent moisture transfer through the fabric.

7. The apparatus of claim 5 wherein the fabric includes a weaving pattern configured to substantially prevent moisture transfer through the fabric.

8. The apparatus of claim 5 wherein the fabric includes a non-woven sheet configured to substantially prevent moisture transfer through the fabric.

9. The apparatus of claim 1 wherein the second layer includes a membrane configured to substantially prevent moisture transfer through the second layer.

10. The apparatus of claim 1 further comprising a non-skid material affixed to the second musical instrument facing side of the second layer, the non-skid material configured to substantially prevent movement of the apparatus relative to the musical instrument.

11. The apparatus of claim 1 wherein the second musical instrument facing side of the second layer includes an adhesive material configured to adhere the apparatus to the musical instrument.

12. An apparatus for protecting a musical instrument and the player of said musical instrument, the apparatus comprising:

a first layer including a moisture permeable and wicking material configured to wick fluid and moisture across and through the layer, the first layer having a first player-facing surface and a first musical instrument facing surface;

a second layer including a moisture absorbing material, the second layer having a second player-facing surface and a second musical instrument facing surface, wherein the second player-facing surface abuts the first musical instrument facing surface of the first layer; and a third layer including a third player-facing surface and a third musical instrument facing surface, wherein the third player-facing surface abuts the second musical instrument facing surface of the second layer, the third layer including a moisture impermeable material configured to prevent the wicked fluid and moisture from coming into contact with the musical instrument, and adapted to prevent damage to the surface of the musical instrument.

13. An apparatus for protecting a musical instrument and the player of said musical instrument, the apparatus comprising:

a first layer including a moisture absorbing material configured to absorb moisture, the first layer having a first player-facing surface and a first musical instrument facing surface; and a second layer including a second player-facing surface and a second musical instrument facing surface, wherein the second player-facing surface abuts the first musical instrument facing surface of the first layer, the second layer including a moisture impermeable material configured to prevent the absorbed moisture from coming into contact with the musical instrument, and adapted to prevent damage to the surface of the musical instrument.

14. An apparatus for protecting a musical instrument and the player from said musical instrument, the apparatus comprising:

a first layer including a first moisture absorbing material, the first layer having a first player-facing surface and a first musical instrument facing surface;

a second layer including a moisture wicking material configured to wick fluid into a second moisture absorbing material of the second layer, the second layer having a second player-facing surface and a second musical instrument facing surface, wherein the second player-facing surface abuts the first musical instrument facing surface of the first layer; and a third layer including a third player-facing surface and a third musical instrument facing surface, wherein the third player-facing surface abuts the second musical instrument facing surface of the second layer, the third layer including a moisture impermeable material configured to prevent the wicked fluid and moisture from coming into contact with the musical instrument, and adapted to prevent damage to the surface of the musical instrument.

* * * * *